United States Patent [19]

Toti

[11] Patent Number: 4,945,624

[45] Date of Patent: Aug. 7, 1990

[54] METHOD OF FORMING AND ASSEMBLING DECORATIVE AWNING AND BUILDING FACIA

[76] Inventor: Andrew J. Toti, 311 W. River Rd., Modesto, Calif. 95351

[21] Appl. No.: 261,513

[22] Filed: Oct. 24, 1988

Related U.S. Application Data

[62] Division of Ser. No. 764,296, Aug. 9, 1985, Pat. No. 4,796,393.

[51] Int. Cl.[5] ..... B23P 11/02

[52] U.S. Cl. ..... 29/453; 29/897.32

[58] Field of Search ..... 29/453, 155 R; 52/76, 52/75, 74, 16, 462, 469

[56] References Cited

U.S. PATENT DOCUMENTS

| | | | |
|---|---|---|---|
| 1,147,582 | 7/1915 | Von Uffel | 52/462 |
| 3,218,773 | 11/1965 | Heirich | 52/74 X |
| 3,234,697 | 2/1966 | Toti et al. | 52/75 |
| 3,932,968 | 1/1976 | Heirich | 52/74 |
| 4,168,596 | 9/1979 | Yoder, Jr. | 52/462 |
| 4,546,586 | 10/1985 | Knudson | 52/469 |

OTHER PUBLICATIONS

Kirsch Sunaire Publication, 6/1963.

*Primary Examiner*—Charlie T. Moon
*Attorney, Agent, or Firm*—Philip A. Dalton

[57] ABSTRACT

A metal awning assembly which includes a main awning body section comprising a plurality of individual metal panel sections each having a prearranged curvature and being joined in side-to-side relation. Each of the individual panel sections comprises a sheet of thin gage metal formed with a plurality of individual longitudinal rib sections mutually spaced from each other. Each of the rib sections and intervening panel regions have light transverse corrugations formed therein. Each of the panel sections include male and female rib sections formed on opposite edges of the panel with each of the male and female rib sections on adjacent panel sections being snapped together to hold the panel sections together. Alternately a longitudinal cap holds the male/female rib joint together. Panel forming and shaping apparatus is disclosed as well as overall framing and mounting hardware arrangements and assembly and forming methods and techniques.

2 Claims, 7 Drawing Sheets

FIG. 4
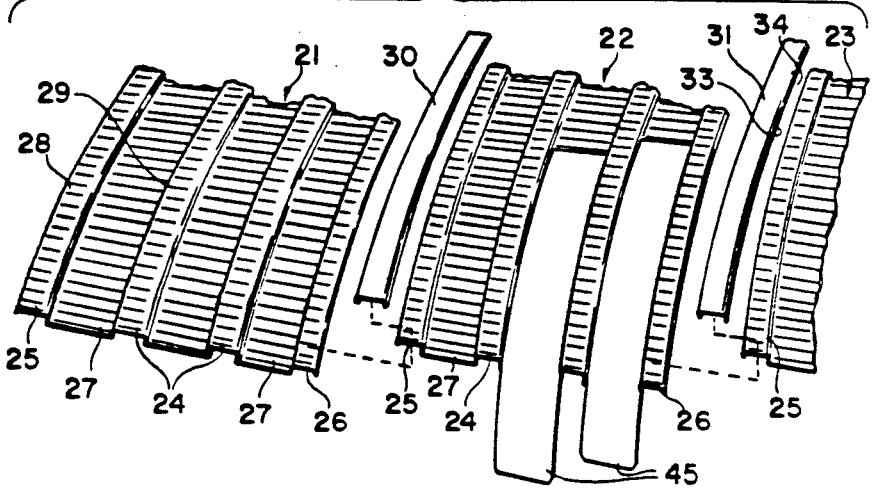
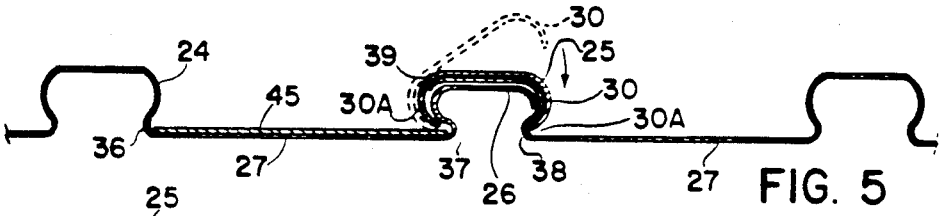
FIG. 5
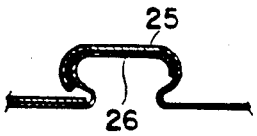
FIG. 6
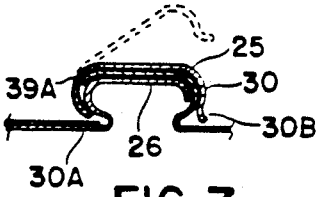
FIG. 7
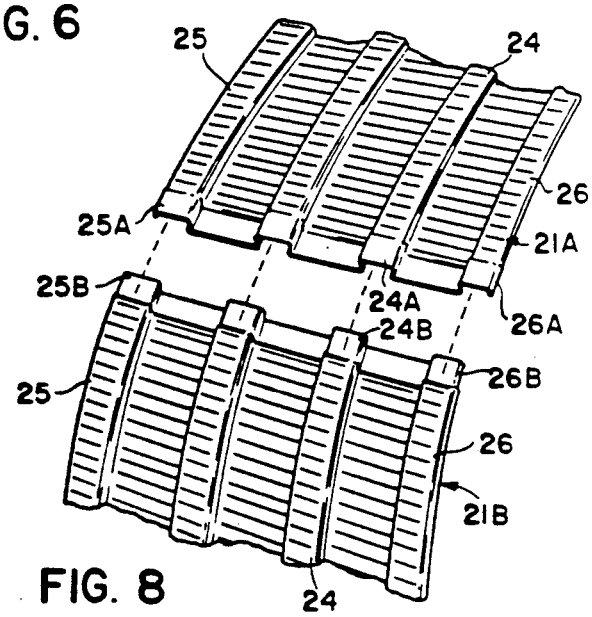
FIG. 8

METHOD OF FORMING AND ASSEMBLING DECORATIVE AWNING AND BUILDING FACIA

This is a division of application Ser. No. 764,296, filed Aug. 9, 1985, now U.S. Pat. No. 4,796,393.

This invention relates generally to a cover structure such as a decorative awning assembly for a window or door or a decorative facia structure for a roof line, a porch or canopy cover and the like, and to methods and apparatus for forming and assembling metal panel structures for use in such structures.

More particularly, this invention relates to an awning or decorative facia structure which can be provided in a kit of component parts to be easily assembled on the job site by relatively unskilled workers. The component parts may be assembled together using simple fastening techniques. In addition, this invention relates to a method for providing the main panel section for such awning or facia structure and to apparatus for forming the individual panel sections which readily snap together and for forming prearranged curved configurations of said panel sections to be assembled into very attractive awning and facia assemblies.

Toti U.S. Pat. No. 3,234,697 discloses an awning construction which uses separate panel sections that include panel edge configurations which enable the panel sections to readily snap together for assembly of the main awning panel without the need for separate fastener elements The awning structure disclosed in this patent provides many of the advantages of a component kit approach to building and installing awnings. However, the structural components have some limitations in terms of the cross sectional shapes of the individual panel sections required to maintain rigidity. Furthermore, the individual panel sections were not readily curved in a longitudinal direction to provide a pleasing awning shape while easily maintaining the snap together feature of the awning panels. In addition, to provide a broad range of colors of the awning required that the individual panel sections be made from all of the different colors desired. Thus, while the awning structure disclosed in the '697 patent provided a generally satisfactory result, there remained abundant opportunity to improve the characteristics of snap together panel systems for awnings and other cover systems.

It is an object of this invention to provide an improved construction for a decorative awning or facia structure on a building.

It is another object of this invention to provide an improved awning and facia structure which permits the selective customization of the color of the structure during the assembly process.

It is another object of this invention to provide an improved awning and facia structure which can employ panel sections with a wide variety of pleasing curved configurations of both a simple and a compound curve type.

It is another object of this invention to provide an improved method for forming the main panel section of an awning or building facia structure from a plurality of separate modular panel sections It is another object of this invention to provide an improved apparatus for forming a straight metal panel section having spaced apart rib sections and corrugated panel sections on said rib portions and intervening panel regions into a curved panel section having a prearranged longitudinal configuration.

One aspect of this invention features a metal awning assembly for a relatively short awning which includes a main awning body section comprising a plurality of individual metal panel sections each having a prearranged curvature and being joined in side-to-side relation. Each of the individual panel sections comprises a sheet of thin gage metal formed with a plurality of individual longitudinal rib sections mutually spaced from each other. Each of the rib sections and intervening panel regions have light transverse corrugations formed therein. Each of the panel sections include male and female rib sections formed on opposite edges of the panel with each of the male and female rib sections comprising an inner hook section bending away from the body of the panel section, a lightly corrugated flat region adjacent the inner hook section, and an outer hook section adjacent the flat region and bending toward the body of the panel section. The outer hook section has a longer hook region on the female rib section, and the male rib section is snapped into the female rib section to hold the panel sections together.

Preferably side panel sections are provided with the respective abutting edges of the main body section and the side panel sections covered with and fastened together with a corner cover panel which is shaped to conform to the configuration of the abutting edges. A top frame assembly defines a channel receiving a top edge section of at least the main panel section and is fastened thereto. A fastening arrangement fastens the top frame to a vertical wall section A. bottom frame assembly defines a channel which receives bottom edge portions of the main and side panel sections of the awning and is fastened thereto.

Another embodiment of this invention features a modified panel assembly for a metal awning, roof facia or the like. A main body section of the panel comprises a plurality of individual elongated metal panel sections, and a joining arrangement for joining the individual sections in side-by-side relation into the main body section. Each of the panel sections comprises a sheet of thin metal material formed with a plurality of individual longitudinal rib sections mutually spaced from each other and including male and female rib sections formed on opposite sides of the panel and mating together for joining the sections in side by side relation. The joining arrangement comprises metal cap means fitted over the mated male and female rib sections to retain the respective ribs securely in joined relationship.

Each of the rib sections preferably has a generally inverted U-shaped cross section with the male and female rib sections having one short leg at the end thereof for ease of mating together. Each of the portions of the panel between successive ribs and each of the flat faces of the ribs parallel to the panel preferably have light, transverse corrugations formed therein to provide added structural rigidity for the panel. The corrugations on the respectively mated male and female rib sections further assist in locking the panel sections together against longitudinal movement relative to each other.

To customize the color of the panel section, provision is made for mounting custom color panel inserts into the individual panels sections after they have been assembled together For this purpose, each of the rib sections includes an indented hook portion in the U-shaped cross sectional configuration in the region adjoining the intervening panel section. A plurality of elongated thin metal sheets are each received between adjacent rib sections on the panel and having a width prearranged such that opposite edges of each the sheet are received in the indented hook portions to retain each sheet in position on the panel. The panel sections that are assembled together may be colored with a neutral color and the basic decorative color appearance of the panel assembly is determined largely by the color of the thin metal sheets inserted between rib sections.

Each of the panel sections preferably has an identical prearranged curved configuration. The metal cap securing the panel sections may have a correspondingly matching curved configuration. Alternatively the cap may comprise a generally straight U-shaped, elongated cap having at least the side portions thereof corrugated and having a plurality of regularly spaced relief cuts formed in the side walls thereof which permit the metal cap to be easily bent to the prearranged curved configuration of the panels.

In most cases the awning or facia structure is adapted to be mounted to a vertical mounting wall element. For this purpose the main body section includes a top portion having a curved configuration forming a top panel edge section disposed substantially orthogonal to the mounting wall element and a bottom portion having a curved configuration forming a bottom panel edge portion disposed substantially parallel to the mounting wall element. The structure further comprises a substantially rigid top frame assembly including a channel receiving the top panel edge and being fastened thereto. A wall mounting arrangement cooperates with the top frame assembly for mounting the top frame assembly to the mounting wall element. A substantially rigid bottom frame assembly including a channel receives the bottom panel edge and is fastened thereto to provide substantial rigidity to the structure at that location.

Preferably at least a pair of side panel sections are disposed between the mounting wall element and the right and left edges of the main panel section. The right and left edges of the main panel section and front edges of the right and left side panels are formed in a miter cut manner to substantially abut each other. At least a pair of corner joint cover sections, formed to match the configuration of the abutting edges of the main and side panel sections, are fastened to each of the abutting edges. The bottom frame assembly is configured to include end portions and a front portion. The front portion is associated with the main panel section and the end portions are configured to receive in the channel therein the bottom edges of the side panels to provide a complete bottom frame around substantially all of the main and side panel edges.

Another aspect of this invention features a pair of main panel sections mounted in spaced parallel arrangement with individual rib sections on each panel in substantial alignment with each other. A plurality of spacer truss elements are mounted between the individual panel sections. Each of the spacer truss elements comprises a main body section with a bent hook section on each end thereof received in one of opposing ones of the rib sections on opposing panel sections and deformed thereinto to retain the spacer truss element in position in the opposed rib sections.

Another aspect of this invention features a method for forming a main panel section for a metal awning or a decorative building facia which includes the following steps:

forming a plurality of flat metal panel sections into straight panel sections having a plurality of spaced apart reinforcing rib sections and male and female edge rib sections which are adapted to snap into each other with light transverse corrugations on the rib sections and in panel regions therebetween;

forming the straight ribbed panel sections into panel sections having identical longitudinal curved configurations; and mounting two or more of the curved ribbed panels together in side-by-side relation by snapping the respective male and female edge rib sections of separate panels together.

Another embodiment of a method of this invention for forming a main panel section for a metal awning or a decorative building facia includes the steps of:

forming a plurality of flat metal panel sections into straight panel sections have a plurality of spaced apart reinforcing rib sections and male and female edge rib sections which are adapted to mate with each other with light transverse corrugations on the rib sections and in panel regions therebetween;

forming the straight ribbed panel sections into panel sections having identical longitudinal curved configurations;

forming an elongated thin strip of metal into a generally U-shaped mounting cap with corrugated sides;

forming a plurality of spaced relief cuts in the corrugated sides of the mounting cap;

mounting two or more of the curved ribbed panels together in side-by-side relation by mating the respective male and female edge rib sections of separate panels together; and fastening the mounting cap over the mated male and females edge rib sections starting at one end of the mated rib sections and forming successive portions of the mounting cap to the curved shape of the mated rib sections as the corrugated sides of the cap are pushed thereover.

This invention also features apparatus for forming a straight metal panel section having a plurality of spaced reinforcing rib sections with light transverse corrugations on flat regions of the rib sections and in panel regions between the rib sections into a curved metal panel section having a prearranged curved configuration. The apparatus includes a rotary die station comprising interengaged upper and lower rotary die assemblies each having a first set of opposing interengaged die sections contacting the panel regions between rib sections and a second set of opposed interengaged die sections contacting the rib sections of the panel. Each of the first and second sets of die sections are carried on a shaft with only one of the opposing sets being powered with the shaft and the other being mounted in a free turning bearing relation to the shaft.

A panel entry guide assembly is provided for guiding a straight panel section into the rotary die station. A set of opposed rotating idler panel guide wheel assemblies guides a curved panel strip out of the rotary die station. The entry guide assembly and the panel guide wheel assemblies are each mounted to individual cantilevered bracket assemblies rotationally mounted at substantially the neutral plane position of a panel passing through the rotary die wheel of the rotary die station. These bracket assemblies are geared together for controlled opposite angular rotation to adjust simultaneously and comparably the entrance and exit angles of a panel passing through the interengaged die wheels. An adjusting assembly is provided for adjusting the positions of the cantilevered bracket assemblies to control the direction and degree of curvature of a panel passing through the die wheels.

This invention provides several advantages over prior approaches to providing decorative metal awnings and decorative rough facia for buildings. The panel assembly of this invention enables awnings and facia to be constructed in a wide variety of very attractive shapes which cannot be achieved with any prior art metal awning or facia system. The basic appearance of the individual panel sections is much improved over the prior art while maintaining the feature of being able to readily assemble the individual panel sections in side-by-side relation into a large area panel having good structural rigidity.

When the invention is applied to an awning facia structure, it provides the advantage of permitting prefabrication of the individual components of the final awning assembly on a production basis. These individual components of the assembly can then readily be shipped to the job site and assembled using relatively simple tools and techniques, basically involving simple drilling and screwing of certain of the panel components together. The details of the simplicity of the assembly and mounting operation will be discussed in detail below.

One of the main advantages of this invention is that the structure of the individual metal panel sections, together with the manner in which the individual panel sections are joined in side-by-side relation, permits customizing the color of the awning or facia with thin elongated metal panel inserts which have the desired color. The appearance of the panels themselves is very attractive where a standard set of stock colors for the awning or facia is desired. The combination of the longitudinal ribs and the transverse light corrugations in the individual panels provides a woven texture appearance to the awning or facia assembly. The shape of the overall assembly can closely imitate a fabric awning.

The individual flexible panel sections which can be mounted between the ribbed regions on the panel sections to customize the color can be either flat, unpatterned sheets or can be weave patterned slats formed using the method and apparatus of Toti U.S. Pat. No. 4,499,938, the disclosure of which is incorporated herein by reference. The weave texture produced on the long, thin slats, together with the transverse corrugations on the ribs provides a very attractive weave-like appearance to the finished awning assembly. Utilizing either the unpatterned or patterned strips, customizing of the main color of the awning can be accomplished in one of eighty or more decorator colors simply by maintaining an inventory stock of the inexpensive slats. This enables the awning structure or facia structure to be matched to the color scheme of any residential or commercial building.

The combination of mechanical and esthetic characteristics of this invention will enable the basic advantages of metal awnings and facia, namely long service life, freedom from rot and rust, and the like, to be achieved without sacrificing esthetic appearance and decorative quality of the awning or facia structure. At the same time, these improved aspects of the invention are achieved without costly metal forming and assembly operations. While each of the metal forming operations involves a special tooling to form the individual panel sections and to bend the panel sections to the desired shape, this tooling is available in accordance with this invention to provide high production throughput in the formation of the individual straight panels and the curving of those panels to the desired final configuration.

The above objects, features and advantages of this invention will be more clearly understood from the detailed description given below in conjunction with the accompanying drawings. In addition, other objects, features and advantages will be discussed below in conjunction with the drawing figures.

FIG. 4 is a partial exploded view of panel sections in accordance with this invention and methods for assembling panel sections into a large area panel.

FIGS. 5–7 are fragmented sections views showing various embodiments of the panel joining features of this invention.

FIG. 8 is a perspective view of a longitudinal panel joining feature of this invention.

Figure 1:
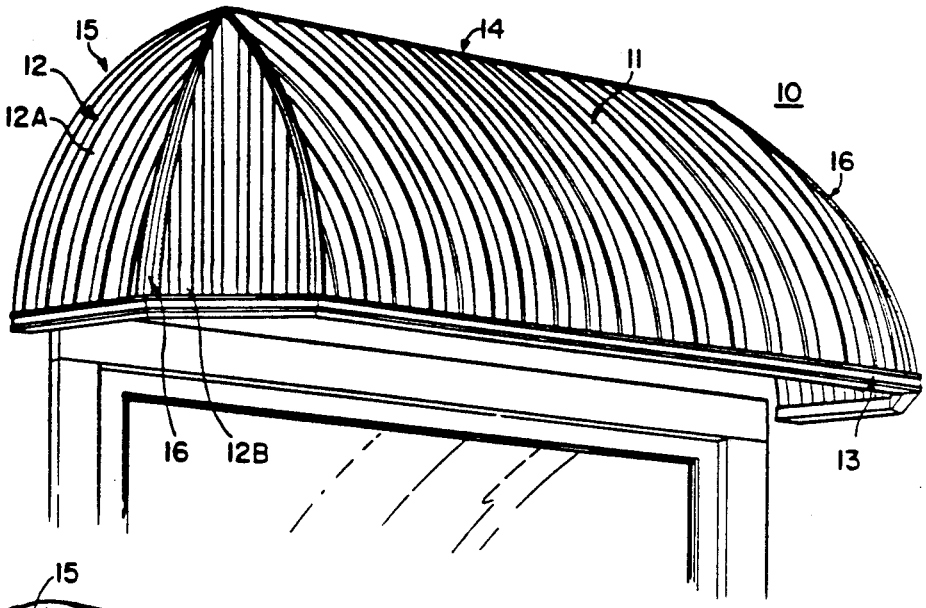
FIG. 1 is a perspective view of one version of an awning assembly using the panel section features of this invention.
Figure 2:
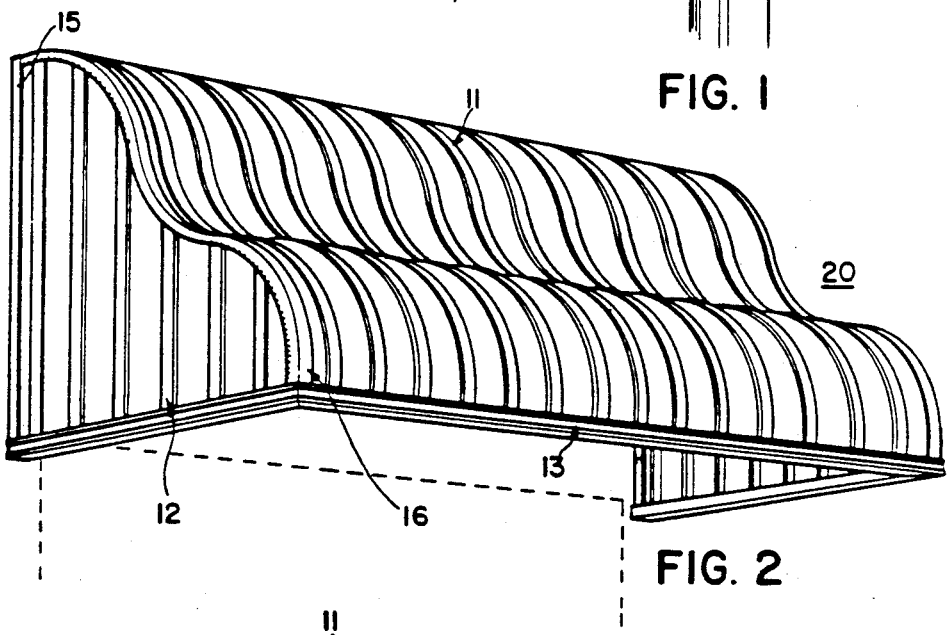
FIG. 2 is a perspective view of another version of an awning or facia structure illustrating use of the features of this invention.

FIG. 1 depicts an awning structure 10 which is illustrative of the attractive overall shape which can be achieved utilizing the special panel section and assembly techniques in accordance with this invention. FIG. 2 shows a second awning structure 20 which has a different three dimensional shape, but utilizes the same individual panel section formation, bending and assembly technology provided by this invention. The strong and dynamic esthetic appeal shown by the awning or facia assemblies 10 and 20 in FIGS. 1 and 2 illustrates that this invention enables the metal awning and facia structure to imitate closely the types of structures which could otherwise only be achieved utilizing customized fabric awnings mounted over shaped metal frames or cages.

Because the basic structures of the awning or facia assemblies 10 and 20 depicted in FIGS. 1 and 2 is essentially the same, these structures will be described together using common reference numerals. However, it will be recognized that the reference numerals refer to panel sections and other components of different shapes so the overall description must be taken in a generic sense. Throughout the remainder of this specification, the overall structures will be referred to for convenience as awning structures with the understanding that the invention is equally applicable to decorative building facia and roof structures. Accordingly, the use of the term awning throughout the specification does not limit the scope of the application of the technology of this invention.

The typical awning structure utilizing the technology of this invention will comprise a main panel section 11, a side panel arrangement 12, a bottom frame assembly 13, a top frame assembly 14, a side frame assembly 15, and corner cover panels 16. The top frame assembly 14 and side frame assembly 15 are adapted to cooperate with mounting brackets (as will be described below) to hang the awning assembly and retain it in position on the mounting wall behind the awning.

As shown in FIG. 1, the side panel assembly 12 in this case includes a pair of side panels 12 A and 12 B which provide a semi-octagonal shape to the basic cross sectional configuration of the awning assembly as represented by the shape of the bottom frame 13. It Will be appreciated that, instead of this shape, a generally rectangular cross sectional configuration for the awning, using a single side panel, could also be provided using this same basic technology. As shown in FIG. 1, each of the individual side panels 12 A and 12 B is curved from top to bottom, which helps to reinforce the overall fabric-like appearance of the awning structure. It will be appreciated that, as shown in FIG. 2, the side panel assembly 12 may be fashioned from a straight panel. This provides a more simple side panel assembly and mounting which may be more utilitarian in certain instances, especially when adapted to use in building facia assemblies.

It should be appreciated that the main panel section 11 in FIG. 2. has a compound curve, whereas the main panel section 11 in FIG. 1 has a simple curve. The ability to provide both simple and compound curves for the main panel section, together with the fabrication of that section from individual separate panel sections having identical curvatures is one of the main advantageous features of this invention.

Figure 3:
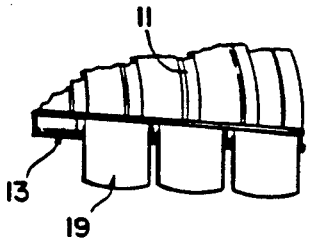
FIG. 3 is a partial perspective view showing a scalloped panel insert in the bottom frame of an awning in accordance with this invention.

FIG. 3 illustrates a variation on the decorative appearance of the awning structures depicted in FIGS. 1 and 2 by addition of a scalloped border assembly 14 which may be snapped into a front channel portion of the bottom frame assembly 13 which will be described in more detail below. This optional scalloped edge enables the technology of this invention to further initiate the appearance of a fabric awning where the bottom edge of the awning is scalloped.

Referring now to FIG. 4, the structure, arrangement and assembly of individual panel sections 21–23 into a main awning body section (e.g., section 11 in FIG. 1) will now be described. Individual metal panel sections 21, 22 and 23 are formed to be joined in side-to-side relation with a+ male rib portion 26 received in a female rib portion 25. Each of the individual panel sections, for example panel section 21, comprises a sheet of thin gauge metal formed with a plurality of individual longitudinal rib sections 24, 25 and 26 mutually spaced from each other. It is preferable that each of the rib sections have, on their top portions 28 and 29, light transverse corrugations formed therein. The metal from which the panel is formed is preferable aluminum having a thickness in the range of 0.018 inch–0.040 inch. The corrugations in the ribs and intervening panel portions are preferably formed to a depth, measured from the neutral position of the panel, of about 0.030 to 0.080 inches. While the other panel section dimensions are not critical, it has been found convenient to utilize panel sections having a total width of about eight inches with four longitudinal rib sections thereon, each having a width of about one inch and a depth of about one-half inch. Conveniently, the intervening panel regions 27 between reinforcing rib sections 24 are about two inches. As shown in FIG. 4, and particularly shown in cross-section in FIG. 6, one version of the overall main awning body section utilizes an arrangement in which the female edge rib 25 snaps over the male edge rib 26. On an awning body section which is relatively short, i.e., where the longitudinal dimension of the awning section is on the order of twenty to forty-eight inches, this snap together arrangement of the male and female edge ridge sections provides sufficient reliability in the panel-to-panel joint combined with other structural elements of the overall assembly, such as top and bottom frames and the like, to avoid the necessity for any other joining or fastening components to be utilized. In the arrangement shown in FIG. 4 generally and in FIGS. 5 and 7, in particular, a joining means in the form of a generally U-shaped metal cap 30 is mounted over the mated male and female edge ribs 25 and 26 to ensure a secure joining of the side-by-side panel sections. This cap 30 should preferably be used in any panel sections where the panel has a straight panel configuration (i.e., is not curved in either a simple or complex fashion) or where the length of the individual panel sections exceeds about forty-eight inches. It has been found that the snap together of the male and female edge rib sections works particularly well for short curved awning panel sections. The curvature of the panel section, in particular, seems to assist in holding the panel sections together with good transverse joining power.

As shown in FIG. 4, the metal cap may take one of two forms. Metal cap 30 is formed from aluminum, steel or vinyl material with a thickness in the range of 0.015 to 0.040 inches and longitudinal curvature matching that of the panel sections 21 and 22 with which it will be used. Metal cap 31 is formed with an initial straight longitudinal configuration However, metal cap 31 is formed from a relatively thin gauge of metal or plastic material also having a generally U-shape, but with several added features which permit it easily to be configured, as it is being pushed or snapped in place, to the actual curvature of the female edge rib 25 over which it is mounted. Specifically, at least each of the side sections 33 of the cap 31 are formed with light corrugations therein. In addition, where the cap 31 may have to be bent a substantial degree to conform to a small radius of curvature of the associated panel section, relief cuts 34 are formed at intervals in the corrugated side portions 33 to permit a greater degree of bending of the cap 31. Each of the caps 30 and 31 may have light transverse corrugations on the top portions thereof if desired. If such transverse corrugations are provided, they should match in pitch and dimension pretty closely to the light transverse corrugations on the female edge rib so that the caps 30 and 31 can be snugly fit over such female edge rib.

As shown in FIG. 4, individual thin metal strips 45 having a length corresponding to the total length of each panel section 21 and 22 may be inserted between respective longitudinal ribs 24, 25 and 26. These individual thin metal strips 45 may be flat metal strips generally formed of the same aluminum strip stock as horizontal or vertical blinds. If it is desired to form a decorative weave pattern in strips 45, this can be accomplished using the method and apparatus disclosed in above-referenced Toti U.S. Patent. It should be appreciated that the color of the strips 45, when utilized, will provide the dominant color theme of the overall panel structure. Accordingly, the individual strips 45 provide one of the primary advantages of this invention in that the awning or facia structure from which the individual panels 21 and 22 are formed may be customized to the color scheme of the building as it exists at the time of installation. As many as eighty or more decorator colors of varying color types, tones and shades may be provided for this custom decorating aspect of the invention. The basic panel sections 21, 22 and 23 themselves will be painted with a particular color and a few stock, neutral and nonneutral colors may be provided, especially colors in the earthtone category. The individual decorative metal strip sections 45 may then be employed with neutral background tones on the panel sections themselves.

It will also be appreciated that, with the use of the separate decorative metal inserts 45, the color of the awning or facia can be changed at the time that a building structure is repainted with a different color scheme simply by removing and replacing the thin metal strips 45. The metal strips 45 are flexible enough to be bowed transversely until they snap out of the region between adjacent ribs. Correspondingly, they can be readily snapped into the space between adjoining ribs.

Referring to FIG. 5, it will be seen that the decorative thin metal strips 45 are retained in position between the respective rib sections of the panel by having their edges received in indented hook portions 36 on the central longitudinal ribs 24 and indented hook portions 37 and 38 on the male and female rib sections 26 and 25. The width of the individual metal strips 45 is preferably formed such that the strip will have a slight transverse bow to it and thereby exert pressure against the respective hook portions 36, 37 and 38. This will ensure that the decorative strips 45 do not rattle in the wind because of a loose fitting relationship.

FIG. 5 shows a panel section to panel section joint arrangement in which the main holding power of the joint is provided by the metal cap 30 which mounts in tight fitting relation over the mated male and female rib elements 25 and 26. As shown by the dashed phantom view of the metal cap 30, in this embodiment one side wall 30 A of the metal cap may be placed in the relatively deep hook portion 37 of the male edge rib 25 and then snapped in a hinge snapping movement over on the female edge rib 25 to be received in the hook portion 38 on the female edge rib 26. Alternatively, the cap 31 can be snapped over the metal male and female ribs. FIG. 6, as already described, shows an arrangement in which the male and female edge ribs snap together to form the entire joint. FIG. 7 shows an arrangement where the metal cap 30 has a simple hook side portion 30 A and a reverse hook side portion 30 B to be snapped over the female rib 25. It will also be seen in FIG. 7 that the edge hook portion 39 A of the female edge rib 35 is shortened in this embodiment so that the female edge rib 25 can simply be mounted over the male edge rib 26 in a sliding engagement. In this configuration of this invention, the entire holding power of the joint relies on the metal cap 30 and this is sufficient joining power in most situations.

It will thus be appreciated that a variety of mating rib joints for adjacent panel sections can be employed with this invention. Additional variations beyond those described above could also be utilized. It will be further appreciated that, in overall panel body sections which are very long, additional security in fastening the male and female rib elements together could be provided by using pop rivets or machine screws extending through the male and female rib elements if desired. In most situations such added measures will not be necessary and would add to the cost of installation.

It will be seen from the above description that this invention features a highly modular approach to forming an overall integrated awning or decorative facia structure. The individual modular components may be formed as standard components. The components are readily assembled together without sophisticated assembly techniques being required. The overall height and width of the main panel sections as well as the curved configuration thereof may be prearranged so that the panel sections are readily assembled at the job site.

FIG. 8 illustrates that, in additional to individual panel sections being joinable in side-to-side relation, it is also possible to join individual panel sections 21 A and 21 B in end-to-end relation provided that special male and female rib portions are formed on the joining ends of the panel sections These can be formed as the panel sections are cut to length by a combined panel shearing and die forming apparatus (not shown). The structure and operation of such a die forming apparatus is readily apparent to the average die maker and need not be discussed herein.

As shown in FIG. 8, each of the central reinforcing ribs 24 has a female portion 24 A which receives a male portion 24 B in either sliding or snap together engagement. Similarly, the female edge rib 25 has a female end portion 25 A which receives a male end portion 25 B. The male edge rib 26 on each of the panels 21 A and 21 B has either a female portion 26 A or a male portion 26 B formed therein. This longitudinal joining arrangement may be utilized to join flat strip sections to curved strip sections or to join respectively flat tangential portions of generally curved strips together to form a complex or compound curve arrangement. It may also be used in a variety of other longitudinal panel joining arrangements to build a panel section of any desired length and longitudinal configuration. If desired, sheet metal screws or pop rivets could be utilized to securely fasten the individual sections 21 A and 21 B together at the region of overlap.

Figure 10:
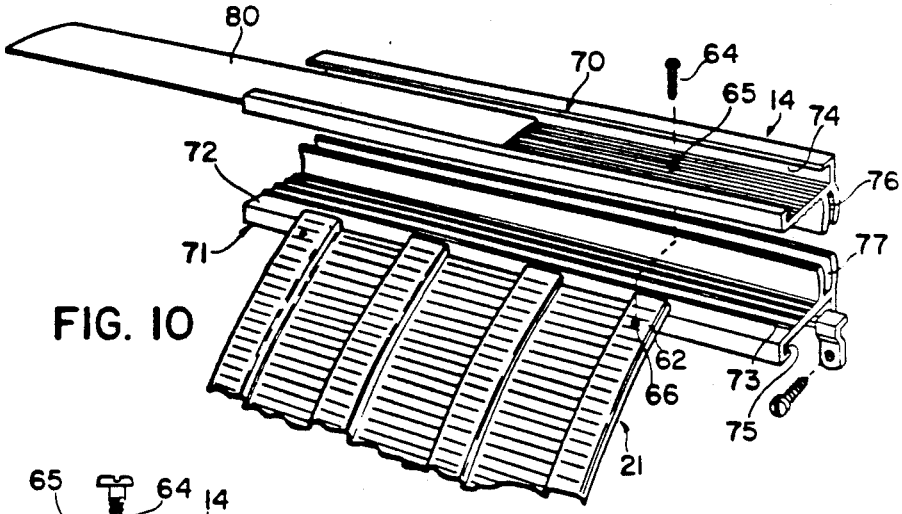
FIG. 10 is a fragmented exploded view illustrating a top frame mounting arrangement in accordance with this invention.
Figure 9:
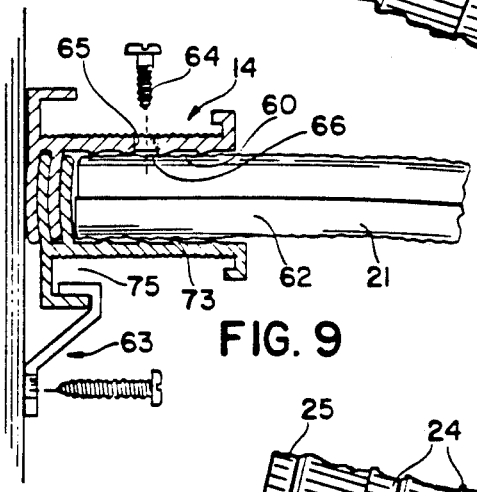
FIG. 9 is a section view illustrating a top frame mounting arrangement and a wall mounting arrangement in accordance with this invention.

Referring now to FIGS. 9 and 10, a prefered structure and assembly of top frame means 14 will be described. Top frame assembly 14 includes a channel 60 which receives a top edge section 62 of panel section 21 (but only after the panel sections have all been put together to make a complete horizontal main panel body section). A fastener arrangement involving a machine screw 64 may be utilized to hold the top edge portion 62 in the channel 60. Machine screw 64 may extend through a hole 65 in the top body portion of the frame means and through a hole 66 in one of the reinforcing ribs of the panel section 21. In addition, triangular teeth 73 may be provided on the interior walls of the channel 60 to cooperate with corrugations of the panel in holding the panel 21 in position therein. A fastening arrangement 63 involving a hook-shaped clamp and a screw may be utilized to fasten the top frame assembly 14 to a mounting wall.

As shown particularly in FIG. 10, the top frame assembly 14 is preferably assembled from two identical mating frame elements 70 and 71. Each of the mating frame elements 70 and 71 has a main body section 72 with interengaging fingers 76 and 77 extending inwardly at the rear thereof. These interengaging finger sections push together to form the integrated frame assembly after the top edge portion 62 of the panel section 21 has been fitted between the respective halves of the frame assembly. The bottom channel 75 cooperates with the hook on the mounting arrangement 63 to hold and support the frame. The top channel 74 may receive a decorative metal slat 80 similar to the decorative metal slats 45 utilized as inserts in the main panel sections 21, 22 and 23 shown in FIG. 4.

The top frame assembly 14 extends the entire width of the top edge of the main body section of an awning or decorative facia and is utilized basically to provide rigidity to the top edge of the main panel and as part of a mounting/hanging arrangement. It should be apparent that numerous other types of frame assemblies could be utilized for essentially the same purpose. The advantage of the particular frame approach depicted in FIGS. 9 and 10 is that it provides for ease of attaching the top frame to the top edge 62 of the panel and for ease of mounting the top frame assembly on the vertical mounting wall on which the entire awning or facia is to be mounted. It will be seen that only simple assembly techniques are required to put together and mount this portion of the overall awning assembly. This can be accomplished by relatively unskilled labor.

Figure 12:
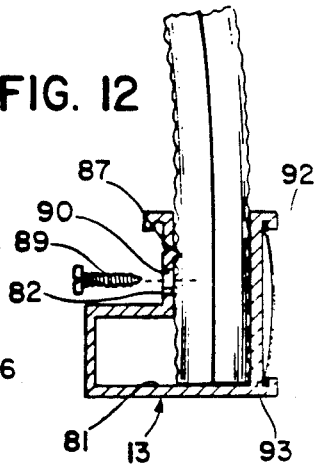
FIG. 12 is a fragmented section view of a bottom frame mounting arrangement in accordance with this invention.
Figure 11:
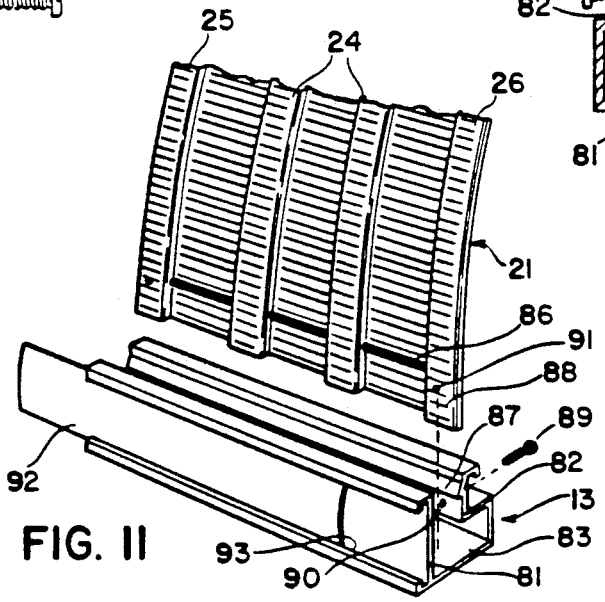
FIG. 11 is a partial exploded perspective view illustrating a bottom frame mounting arrangement in accordance with this invention.

FIGS. 11 and 12 depict a preferred bottom frame assembly 13. Bottom frame assembly 13 preferably is a one piece aluminum extrusion having a generally U-shaped channel formed by a front wall 81, a back wall 81 and a bottom wall 83. The bottom wall 83 and the back wall 82 preferably have the configuration shown to form an integral interior gutter arrangement to carry water away to one side of the bottom section of the awning. Each of the panel sections 21 and the like includes a partial groove cut into the back side of the panel and extending part way through the rib sections 24, 25 and 26. The bottom end section 87 of the panels, after being assembled together in side-by-side relation, is received into the U-shaped channel of the bottom frame member 13 in a sliding engagement, with the generally V-shaped projection 87 being received in the slit 86 formed in the bottom panel portion 88. A machine screw, for example screw 89, may extend through a hole 90 in the back wall 92 of the frame and through a hole 91 in one of the rib portions of the panel 20. A decorative metal strip 92 may be slidingly inserted into a grooved channel arrangement 93 formed in the front of the frame 13.

Referring back to FIG. 1, frame 13 may comprise a single extrusion which is appropriately cut and bent to the shape of the bottom edge configuration of the main body section of the awning and the side panels thereof. Alternatively, each of the separate panels may have a separate frame member mounted thereto with connecting inserts holding the individual frame elements together in a side-by-side relation. If necessary, appropriate mounting screws may be used to hold the inserts and the separate frame elements together. This is all standard assembly technology of which many variations are available. The use of a decorative insert strip 92 enables this portion of the overall assembly to be color coordinated with the main panel sections which receive corresponding decorative strips.

Figure 13:
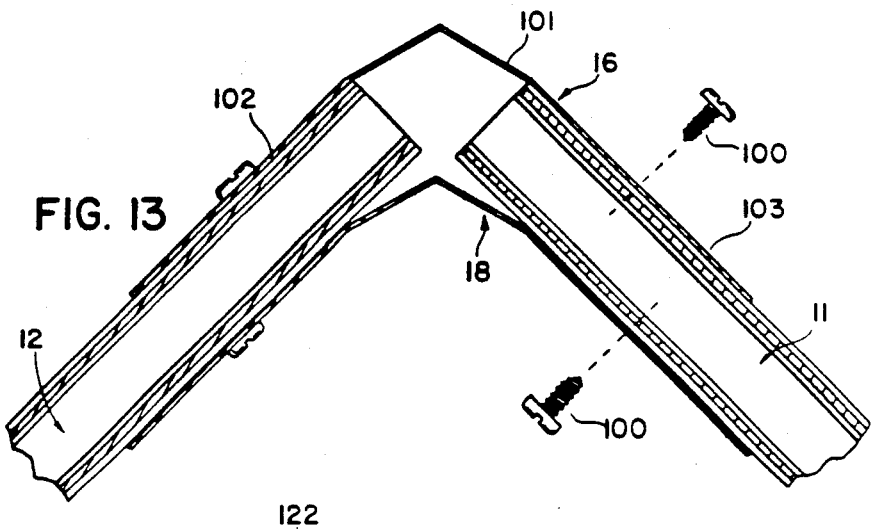
FIG. 13 is is a partial section view of a corner joint cover assembly in accordance with this invention.

FIG. 13 shows a cross-section through the corner cover panel 16 mounted over edge portions of a side panel 12 and a main panel section 11. In the version depicted in FIG. 13, the edge portions of the main panel section 11 and side panel section 12 abut each other at substantially a 90° angle. It will be appreciated that the corner sections utilized in FIG. 1 would have a much smaller angle of about 45°. An outer corner cover 16 and an inner corner cover 18, together with mounting screws 100 which fasten the corner elements to the edges of the abutting panel sections, serve the combination function of adding a decorative cover over the abutting panel corners and providing additional structural rigidity at the abutting corner sections of the panels. The longitudinal configuration of each of the cover panel pieces 16 and 18 matches that of the edge configuration of the abutting panel sections. Apparatus for forming these corner cover panels will be described below.

Referring back to FIGS. 1 and 2, it will be appreciated that the main body panel shown in FIG. 1 and the individual side panels 12 A and 12 B must be cut at their respective edges to come together in an appropriate manner. The type of cut that must be made is not a simple, straight cut, but one that requires a certain curvature in order for the individual panel edges to match each other at the respective corner in a relatively close fitting arrangement. The cuts do not have to be perfectly mitered with respect to each other, since the corner covers 16 and 18 provide some masking of minor irregularities therein.

Figure 14:
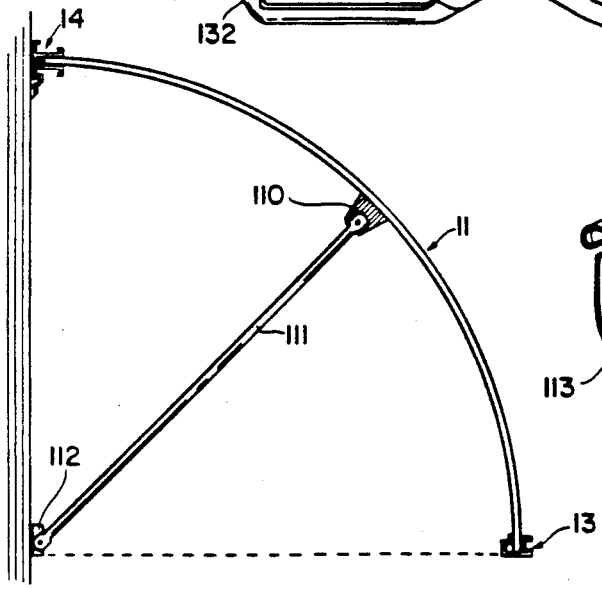
FIG. 14 is illustrates a panel bracing arrangement in accordance with this invention.
Figure 15:
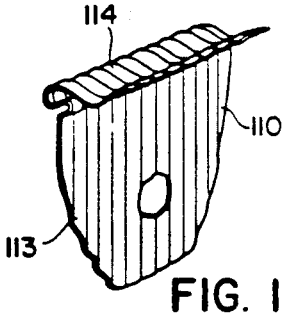
FIG. 15 is a perspective view of a brace bracket in accordance with this invention.

FIGS. 14 and 15 illustrate a bracing arrangement which may be provided for a large awning which requires additional bracing for structural stability. This type of bracing is preferable in a long and wide awning where the panel dimensions from top to bottom and side to side are such that even the substantial rigidity provided by the panel construction and assembly is still insufficient to avoid rattling and other problems. A variety of bracing approaches could be utilized. The one depicted in FIG. 14 utilizes a bracing bracket 110 which is mounted on a brace arm 111 to a wall bracket 112. The bracing bracket 110 includes a corrugated vertical section 113 and a generally S-shaped top leg portion 114. The S-shaped leg portion 114 may be inserted on the interior of one of the longitudinal rib sections of the panel 11 and held in place by forcing the S-shaped leg 114 into a deformed engagement with the interior of the rib so that it is entirely captured therein. This can be accomplished during the assembly of the overall main body panel structure 11 utilizing a tool such as that depicted in FIG. 16.

Figure 16:
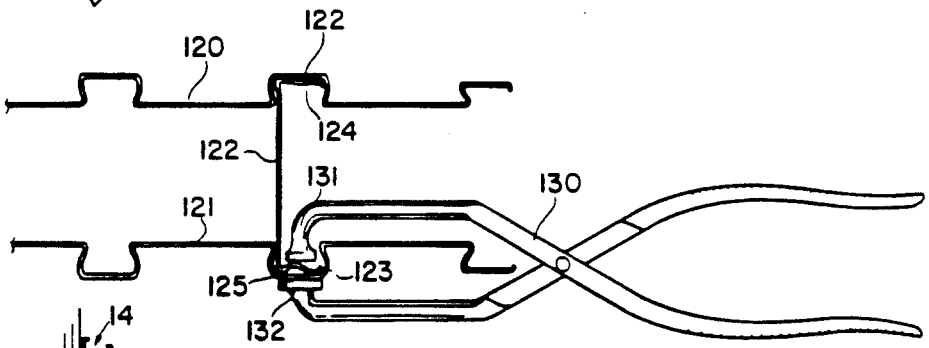
FIG. 16 is a partial section view of a double panel truss brace arrangement in accordance with this invention.

FIG. 16 depicts another use of the panel sections of this invention in a double wall panel construction. Individual parallel panel sections 120 and 121 are arranged to have longitudinal ribs substantially aligned with each other. A truss connecting element 122 is inserted between the panel sections 120 and 121 to be received in rib portions 122 and 123. S-shaped legs 124 and 125 may be deformably mounted within the longitudinal ribs 122 and 123 to provide a bracing between the panel sections. The spacer trusses 122 may be short segments or may extend the full length of the panel. A clamping tool 130 having clamping jaws 131 and 132 may be utilized to deform the S-shaped top and bottom legs 124 and 125 into the interiors of the longitudinal ribs 122 and 123.

Figure 17:
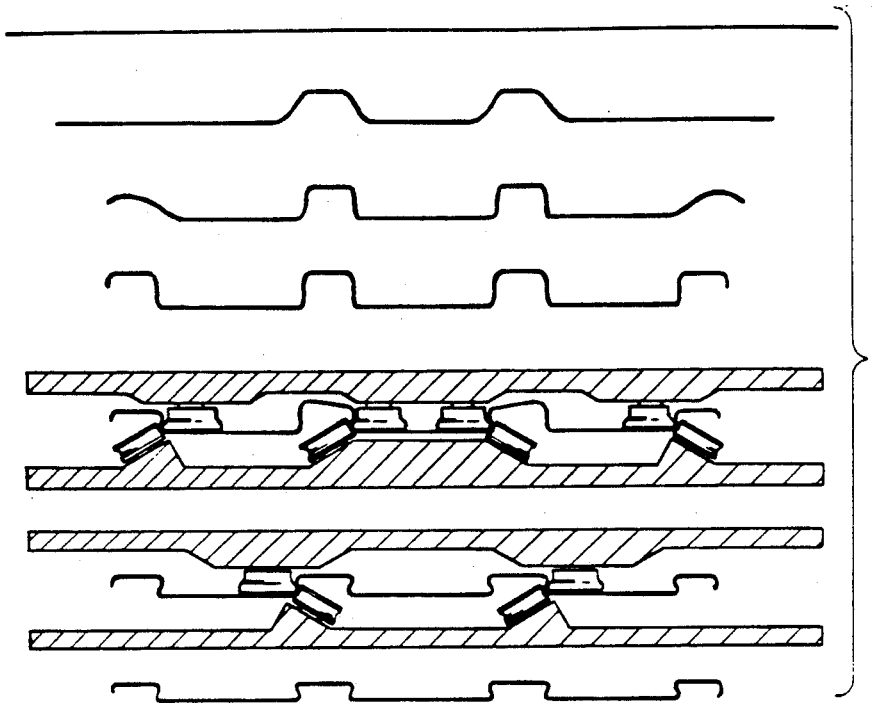
FIG. 17 is a series of views depicting the shaping of a metal sheet into a ribbed panel configuration in accordance with this invention.

Panel sections 21, 22 and 23 depicted in FIG. 4 are preferably formed in a multi-station die forming machine with the action of the individual die stations generally represented by the resulting intermediate panel configuration as depicted in FIG. 17. The action of about seven of the die stations is depicted whereas the initial shaping of the panel may be accomplished in eight or ten actual die stations. Each of the initial die stations is a rotary die station which begins to shape the panel toward the final configuration that it will have. Some of the intermediate die stations such as those depicted in FIG. 17 shape individual portions of the longitudinal rib element. The final die stations will form the light transverse corrugations on the upper surfaces of the longitudinal ribs and the sections of panel in between ribs. The technology involved in forming the corrugated and ribbed panel from a flat, thin piece of aluminum is relatively standard. This multi-station die forming machine must be carefully engineered to form the panel without marring the paint on the panel surfaces, but this can be accomplished using standard skills in the tool and die making art. The die structures and arrangements are apparent from the panel section drawings of FIG. 17.

FIGS. 18–21 illustrate apparatus for controllably bending the panel sections into a prearranged longitudinal curved configuration which may have either a simple one way curve of selectable radius or may have a compound curve of varying radii. The main elements of the panel bending apparatus 120 are a rotary die station 121, a panel input guide assembly 122, a panel output guide assembly 123 and a position adjusting bracket arrangement 124 which controls simultaneously the angular position of the input guide assembly 122 and the output rotary guide assembly 123. In general, forming a smooth bend or curve in a complicated panel section of the type utilized in this invention involves the carefully controlled stretching of one of the front and back elements of the panel section. This is facilitated by the transverse corrugations in the panel section. To form the curved panel sections preferred for use in the awning and facia assemblies of this invention, it is desirable to have very accurate control over the radius of bending and still be able to form the curved panel sections at a high production rate. The panel bending apparatus 120 has special features to perform this task.

Figure 20:
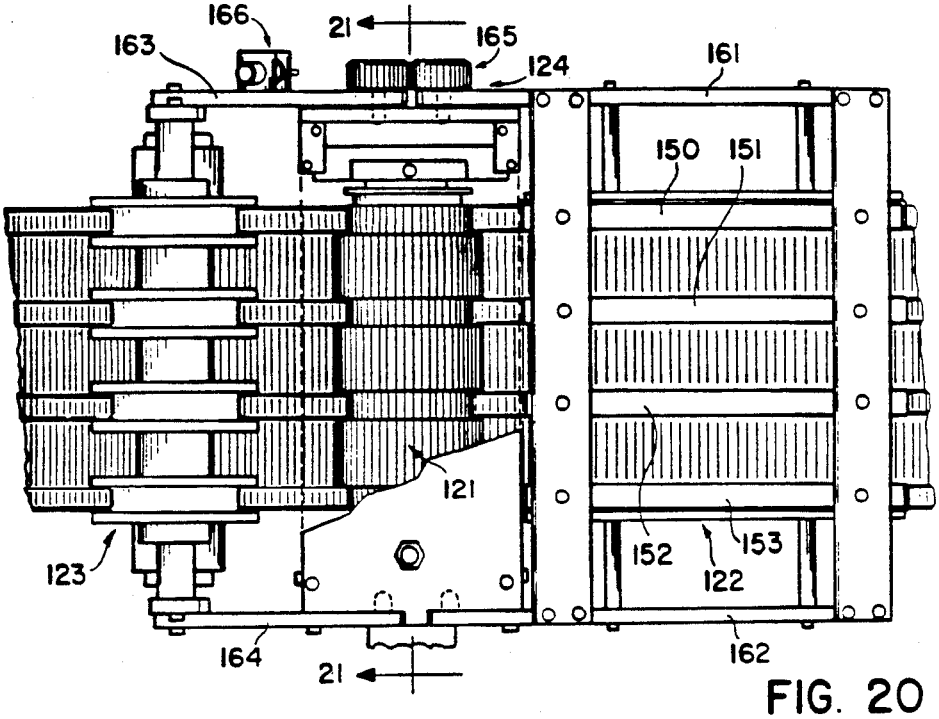
FIG. 20 is a side elevational view of panel shaping apparatus in accordance with this invention.
Figure 21:
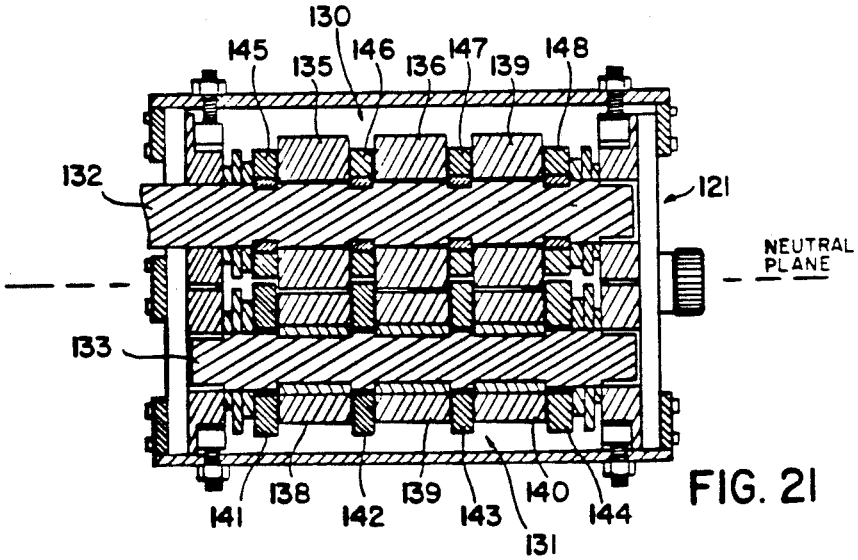
FIG. 21 is a section view of a rotary die station of a panel shaping apparatus in accordance with this invention taken along the lines 21–21 in FIG. 20.
Figure 22:
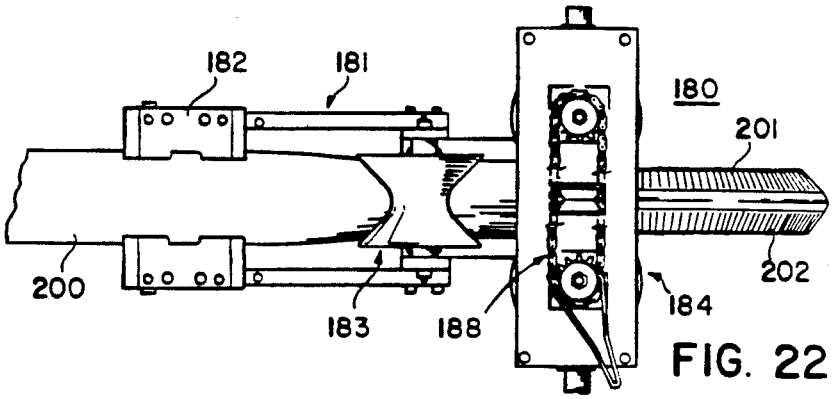
FIG. 22 is a side elevational view of apparatus for forming a corner cover cap in accordance with this invention.
Figure 23:
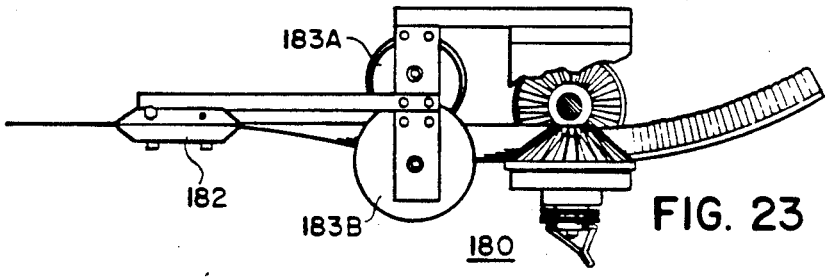
FIG. 23 is a top view of apparatus for forming a corner cover cap in accordance with this invention.
Figure 24:
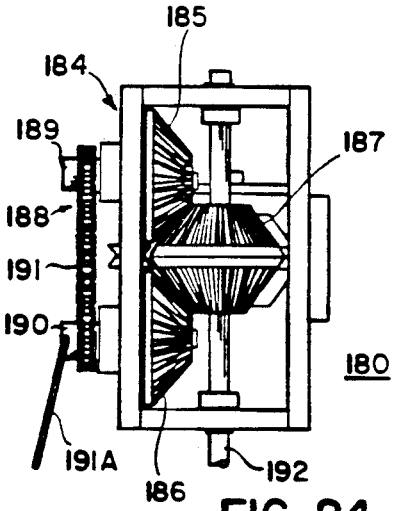
FIG. 24 is an end view of apparatus for forming a corner cover cap in accordance with this invention.

The structure of the rotary die station 121 can best be seen by considering the views thereof in FIGS. 20 and 21. Since this rotary die station lies at the heart of the machine, it will be described first. Rotary die station 121 uses an upper set of die wheels 130 and a lower set of die wheels 131 with the upper set of die wheels 130 being mounted on a powered shaft 132 which is journaled in bearing assemblies on opposite ends thereof. The bottom arrangement of rotary die wheels 131 is mounted on an unpowered shaft 133. The shafts 132 and 133 are geared together for complementary rotation as is typical in rotary die stations of this type.

Upper die wheels 135, 136 and 137 have corrugated circumferential surface configurations matching the corrugation of the panel section. These three main die wheels are keyed to the powered shaft 132 to rotate therewith The widths of the die wheels 135, 136 and 137 correspond to the widths of the panel sections between longitudinal ribs which such die wheels are intended to contact as part of the forming operation of this die station. The main lower die wheels 138, 139 and 140 are mounted to the lower shaft 133 in a free revolving, i.e., nonpowered manner using bearing assemblies. The smaller die wheels 141–144 mounted to the bottom shaft are keyed to the shaft in a fixed position and powered therewith. The corresponding set of smaller upper die rolls 145–148 are mounted to the shaft 132 in a free rolling manner.

The assemblage of upper and lower die wheels is carefully constructed and arranged so that the panel section is easily threaded thereinto with the input guide and output guide in a neutral plane position. The direction and degree of curvature is then controlled by simultaneously controlling the angle of inlet and outlet of the panel from the rotary die station 121. This controls which of the back and front portions of the panel is controllably stretched and to what degree and therefore controls the radius of curvature instantaneously put into the panel section as it is being drawn through the die station. The structure of the panel guide assembly 122 can readily be seen in FIG. 20 and basically involves an arrangement of guide strips 150–153 which comprise teflon coated guide assemblies which contact both top and bottom surfaces of the elongated rib sections of the panel to guide the panel straight into the rotary die station 121.

The output guide assembly 123 comprises a series of four upper and lower guide wheels which similarly contact the upper and lower surfaces of the longitudinal ribs of the panel. Low rolling contact pressure is used to avoid distorting the corrugations on the panel section. It is important that the output guide touch the panel only at one small area as it passes therethrough so that it does not affect the radius of curvature formed in the panel.

Figure 18:
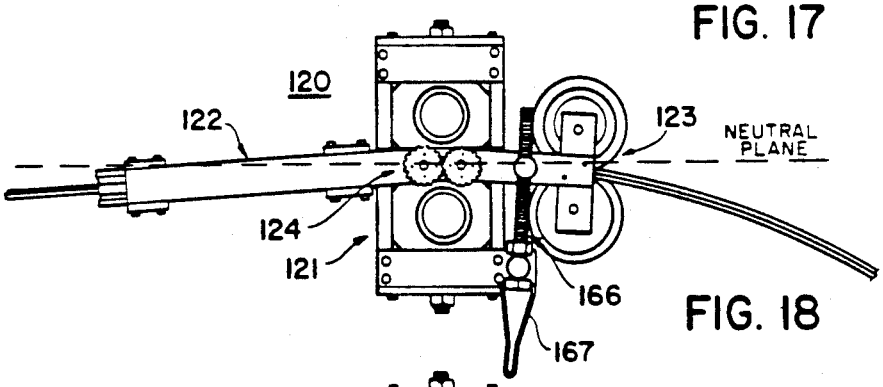
FIGS. 18 and 19 are top views of panel shaping apparatus in accordance with this invention.
Figure 19:
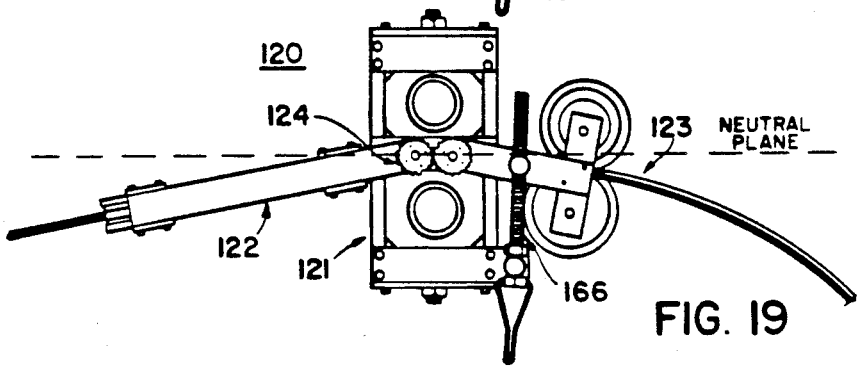

Each of the input guide assembly 122 and output guide assembly 123 are mounted on a cantilevered bracket and position adjusting arrangement 124 which mutually and inversely controls the angular position of the input guide and the output guide relative to the neutral plane passing through the center of rotary die station 121. It will be appreciated that, if both the input guide assembly 122 and the output guide assembly 123 are positioned such that they feed the panel sections straight through the center of rotary die station, i.e., along the neutral plane through the rotary die station 121, no curvature will be produced in the panel section passing therethrough. As shown in FIG. 18, an adjustment of the input and output guides such that they feed the panel in and out of the rotary die station below the neutral axis causes a convex curve to be formed in the panel section passing therethrough. As shown in the view depicted in FIG. 19, the degree of curvature or the radius of curvature of the panel is controlled by how far off the neutral plane the input guide assembly 122 and output guide assembly 123 feed the panel section in and out of the rotary die station 121. If the input and output guide assemblies were positioned at the other side of the neutral axis, a concave curve would be formed in the panel due to controlled stretching of the back side relative to the front.

While control of the off neutral axis input and output feed of the panel section could be done independently, the combined positioning control arrangement 124 is preferred. This positioning arrangement utilizes cantilevered brackets 161 and 162 associated with the input guide and brackets 163 and 164 associated with the output guide station. As shown in FIG. 20, each of these brackets is mounted to the frame of the rotary die station 121 in a cantilevered rotary manner with an interengaged gear assembly 165 producing complementary inverse rotation of one bracket assembly relative to the other for common control of angular position relative to the neutral plane. A hand operated screw adjustment control 166 having a crank 167 thereon provides for manual adjustment of the respective angles of the cantilevered bracket arrangements. It should be appreciated that the adjustment of the angular position of the input and output guides could also be done utilizing various automatic control mechanisms. These automatic control mechanisms could controllably set the angles and could dynamically alter the angles as a panel is passing through the panel curving apparatus. This is especially useful for forming compound curves on a long panel section which can then be cut into shorter panel sections. This should be especially useful in high volume panel production.

Referring now to FIGS. 22–25, apparatus 180 for forming the decorative corner cap for the awning or facia assembly is disclosed. The corner cap shaping apparatus 180 includes a strip guide arrangement 181 including a strip side guide 182 and a strip bending guide 183 which comprises upper and lower forming wheels 183 A and 183 B. Rotary die station 184 utilizes a series of beveled gears which are partly intermeshed to receive the panel 200 after it is passed through the shaping die station 183 to form the corrugated side legs 201 and 202 and to perform the final shaping of the center section of the curved corner cap strip.

Figure 25:
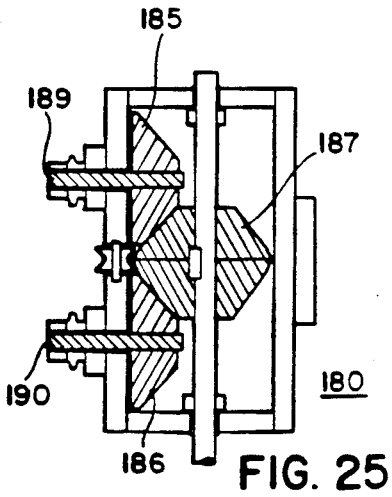
FIG. 25 is a section view of the die forming station of apparatus for forming a corner cover cap in accordance with this invention.

The intermeshed beveled gears 185, 186 and 187 are each mounted on respective shafts 189, 190 and 192. Shaft 192 is powered to drive the die station. As shown in FIG. 25, each of the shafts 189 and 190 have threaded sections (opposite threading) which are received in threaded apertures in the frame so that the degree of engagement of the die wheels 185 and 186 with the beveled wheels 187 can be controlled. A chain and sprocket arrangement 188, including the chain 191 and the hand crank 191 A, provides an arrangement for simultaneous adjustment of the position of the beveled die wheels 185 and 186.

The degree of engagement of the die wheels 185 and 186 controls the depth of corrugation of the side legs 201 and 202 in the corner cover panel, and this in turn controls the degree of curvature of the corner joint cover.

With the corner joint cover forming apparatus shown in FIGS. 19–22, high volume production of the corner joint covers can be performed. Different radii of curvature can be provided for the different types of awnings and decorative facia. It should be further understood that the angle of the beveled gears 185, 186 and 187 controls the cross-sectional angle of the corner joint cover. The various types of awning and facia construction may utilize different angles of corner joints. Thus corner caps having angles of twenty-two degrees and forty-five degrees are generally required for the various types of construction.

It should be apparent from the above description that the panel sections of this invention and the panel assemblies of this invention together with the apparatus for forming and shaping the panel sections provides a unique and highly advantageous approach to constructing and installing metal awnings and decorative facia. It should further be apparent that all of the advantages set forth above are achieved utilizing the panel structures, apparatus and methods described above. It should, however, also be apparent that there are numerous modifications that could be made by persons skilled in the art to achieve the same features and advantages without using precisely the same structures and apparatus disclosed and described herein. These various changes, adaptations and modifications could be made without departing from the scope of this invention as claimed in the following claims.

What is claimed is:

1. In a method for forming a main panel section for a metal awning or a decorative building facia or the like, the steps of:

forming a plurality of flat thin metal panels into straight panel sections having a plurality of spaced apart reinforcing rib sections and male and female edge rib sections which are adapted to snap into each other in locking fashion with light transverse corrugations on said rib sections and in panel regions therebetween for enhancing the structural rigidity of the panels and the locking joinder of the edge rib sections;

forming said straight ribbed panel sections into panel sections having identical longitudinally curved configurations; and mounting two or more of said curved ribbed panels together in side-by-side relation by snapping the respective male and female rib sections of separate panels together.

2. In a method for forming a main panel section for a metal awning or a decorate building facia or the like, the steps of:

forming a plurality of flat thin metal panels into straight panel sections having a plurality of spaced apart reinforcing rib sections and male and female edge rib sections which are adapted to snap-fittingly mate with each other in locking fashion with light transverse corrugations on said rib sections and in panel regions therebetween for enhancing the structural rigidity of the panels and the locking joinder of the edge rib sections;

forming said straight ribbed panel sections into panel sections having identical longitudinally curved configurations;

forming an elongated thin strip of metal into a generally U-shaped mounting cap with corrugated sides and spaced relief cuts therein; and mounting two or more of said curved ribbed panels together in side-by-side relation by snap-fittingly mating the respective male and female edge rib sections of separate panels together; and fastening said mounting cap over said mated male and female edge rib sections starting at one end of said mated rib sections and forming successive portions of said mounting cap to the curved shape of said mated rib sections as said corrugated sides of said cap are pushed thereover.

* * * * *